US010289051B2

(12) United States Patent
Ito

(10) Patent No.: US 10,289,051 B2
(45) Date of Patent: May 14, 2019

(54) IMAGE FORMING APPARATUS

(71) Applicant: CANON KABUSHIKI KAISHA, Tokyo (JP)

(72) Inventor: Tsubasa Ito, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/906,047

(22) Filed: Feb. 27, 2018

(65) Prior Publication Data

US 2018/0246457 A1 Aug. 30, 2018

(30) Foreign Application Priority Data

Feb. 28, 2017 (JP) ..... 2017-035778

(51) Int. Cl.
*G03G 15/00* (2006.01)

(52) U.S. Cl.
CPC ..... *G03G 15/657* (2013.01); *G03G 15/5029* (2013.01); *G03G 2215/00413* (2013.01); *G03G 2215/00679* (2013.01); *G03G 2215/00721* (2013.01); *G03G 2215/00945* (2013.01)

(58) Field of Classification Search
CPC ..... G03G 15/657; G03G 15/5029; G03G 2215/00413; G03G 2215/00721; G03G 2215/00945; G03G 2215/00679
See application file for complete search history.

(56) References Cited

U.S. PATENT DOCUMENTS

2007/0182091 A1* 8/2007 Kubochi ..... G03G 15/657 271/265.01
2017/0227897 A1* 8/2017 Kaino ..... G03G 15/2028

FOREIGN PATENT DOCUMENTS

JP H05107966 A 4/1993
JP 2015094932 A 5/2015

* cited by examiner

*Primary Examiner* — Susan S Lee
(74) *Attorney, Agent, or Firm* — Rossi, Kimms & McDowell LLP

(57) ABSTRACT

Disclosed is an image forming apparatus, including: a transfer portion configured to convey a sheet and to transfer a toner image to the sheet; a fixing portion configured to convey the sheet at a fixing conveying velocity and to fix the toner image; and a control portion configured to control the fixing portion such that the fixing conveying velocity is changed to a first velocity or to a second velocity which is lower than the first velocity, wherein the control portion can set a plurality of velocity bands each of which is a combination of the first velocity and the second velocity, the control portion can perform a changing of the velocity band a several times based on the state of the loop of the sheet while the transfer portion and the fixing portion are conveying the sheet.

17 Claims, 7 Drawing Sheets

IMAGE FORMING APPARATUS

BACKGROUND OF THE INVENTION

Field of the Invention

The present invention relates to an image forming apparatus such as a copying machine, a facsimile machine, a multifunction printer, having an image forming portion for forming an image and for recording it on a sheet.

Description of the Related Art

In an image forming apparatus adopting an electro-photographic system, after a toner image on the image bearing member is transferred to a sheet at the nip portion (transfer nip portion) between the image bearing member and the transfer roller, this sheet is led to the nip portion (fixing nip portion) between the fixing member of the fixing portion and the pressure roller via a conveying guide. At this time, in a state where the leading end of a sheet has entered the fixing nip portion, the trailing edge of the sheet may have not passed through the transfer nip portion yet. On the other hand, due to a thermal expansion, an individual difference, usage environment or secular change of the pressure roller provided at the fixing portion, a difference may occur between the sheet conveying velocity at the fixing nip portion (fixing conveying velocity) and the sheet conveying velocity at the transfer nip portion (transfer conveying velocity). In such a case, when the fixing conveyance velocity exceeds the transfer conveying velocity, a phenomenon occurs in which the sheet bearing an unfixed toner image is pulled toward the fixing portion between the fixing nip portion and the transfer nip portion, which may cause image deterioration. Accordingly, an occurrence of this phenomenon that a sheet is pulled between them can be prevented in advance by forming as a slack portion a loop of a sheet which is conveyed between the transfer portion and the fixing portion.

However, when the fixing conveying velocity is too low as compared with the transfer conveying velocity, an unnecessarily large loop is formed on the sheet. As a result, an unfixed image may be scraped off by the sheet being in contact with the conveying guide. Further, a sheet separation direction (posture) after image transfer in the transfer portion or an incident angle (posture) of the sheet to the fixing portion before fixing becomes unstable and image scattering at the time of transfer separation or an offset may occur in the fixing portion.

Therefore, it is desirable that a sheet is conveyed between the transfer portion and the fixing portion with an appropriate loop being formed. In this case, it is necessary that the transfer conveying velocity and the fixing conveying velocity are almost the same or the fixing conveying velocity is slightly less than the transfer conveying velocity.

Therefore, the means for preventing the occurrence of the phenomenon that the sheet is pulled or is excessively slack by forming an appropriate loop on the sheet between the transfer portion and the fixing portion to solve the image deterioration has been proposed.

For example, a loop detecting sensor for detecting a loop of a sheet is provided in the conveying guide between the fixing portion and the transfer portion. Based on a detection result of this sensor, when a loop amount of the sheet is equal to or smaller than a predetermined amount, a control is performed with a first fixing conveying velocity which is lower than the transfer conveying velocity. Further, an image forming apparatus has been proposed in which when a loop amount is detected to be equal to or larger than a predetermined amount, a control is performed at a second fixing conveying velocity which is higher than the transfer conveying velocity (Japanese Patent Laid-Open Application Publication (No. H05-107966).

An image forming apparatus has been proposed in which a plurality of combinations of the first conveying velocity and the second conveying velocity are provided, a loop amount is detected by the loop detecting portion when the leading edge of a sheet to which a toner image is transferred in the transfer portion reaches the fixing nip portion, an optimum velocity and an optimum velocity control width are selected among the plurality of combinations based on the time which has elapsed until the loop amount is eliminated, and a control is performed (Japanese Patent Laid-Open Application Publication No. 2015-94932).

In conveying the sheet in the fixing unit, all of the outer diameter tolerance of the roller due to a thermal expansion, surface property variation, and an endurance change affect the sheet conveying velocity. Therefore, when determining the fixing conveying velocity, it is necessary to consider the above items for both the transfer portion and the fixing portion. In this case, when the transfer portion includes a belt, it is also necessary to consider the inner peripheral length of the belt and a roller that rotates the belt.

Even in the configuration of the above described prior art, when setting the fixing conveying velocity which is lower than the transfer conveying velocity, it is necessary to set it in consideration of the above various variation factors, and for each image forming apparatus there occur many cases where it becomes unnecessarily slow. This is also similar in the case of setting the fixing conveying velocity which is higher than the transfer conveying velocity.

For this reason, the velocity width between the first sheet conveying velocity and the second sheet conveying velocity in the fixing portion may exceed the velocity width between the first sheet conveying velocity and the second sheet conveying velocity, which is necessary for each image forming apparatus. As explained above, when the velocity width of the first sheet conveying velocity and the second sheet conveying velocity in the fixing portion is great, a velocity change becomes great at the time of switching velocities, and when an unfixed toner on the sheet is permanently fixed at the fixing nip portion, image defects such as image scatters or the image stretches may occur.

Even when a plurality of combinations of the first sheet conveying velocity and the second sheet conveying velocity are provided, the problem similar to the above described one arises because the velocity suddenly changes unless the velocity band is set finely.

SUMMARY OF THE INVENTION

An image forming apparatus according to the present invention, comprising:

a transfer portion configured to convey a sheet and to transfer a toner image formed on an image bearing member to the sheet;

a fixing portion configured to convey the sheet at a fixing conveying velocity and to fix the toner image transferred to the sheet;

a loop detecting portion configured to detect a state of a loop of the sheet, the loop being formed between the transfer portion and the fixing portion; and a control portion configured to control the fixing portion such that the fixing conveying velocity is changed to a first velocity or to a second velocity which is lower than the first velocity based on the state of the loop detected by the loop detecting portion, wherein the control portion can set a plurality of velocity bands each of which is a combination of the first velocity and the second velocity, the control portion can perform a changing of the velocity band a several times based on the state of the loop of the sheet detected by the loop detecting portion while the transfer portion and the fixing portion are conveying the sheet.

Further features of the present invention will become apparent from the following description of exemplary embodiments with reference to the attached drawings.

DESCRIPTION OF THE EMBODIMENTS

Overall Configuration of the Image Forming Apparatus

Figure 1:
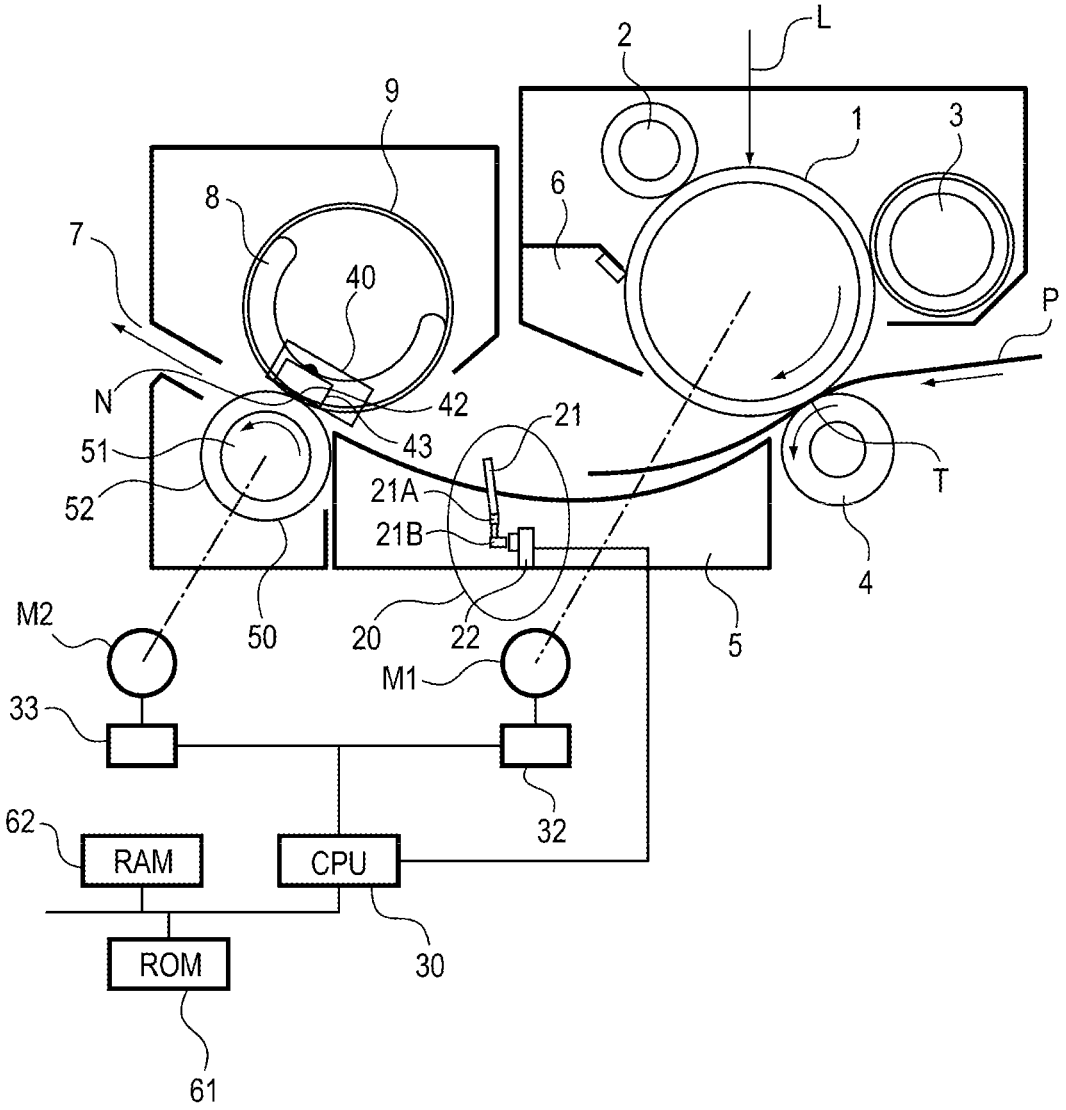
FIG. 1 is a schematic configuration diagram showing mainly a transfer portion and a fixing portion of an image forming apparatus according to an embodiment of the present invention.

FIG. 1 is a schematic configuration diagram mainly showing a transfer portion and a fixing portion of an image forming apparatus according to the present embodiment. The image forming apparatus of the present embodiment is a copying machine or a printer which forms an image by a transfer type electro-photographic process.

First, the overall configuration of the image forming apparatus will be briefly described. The reference character 1 denotes a drum type electro-photographic photosensitive member (photosensitive drum) as an image bearing member which is rotationally driven at a predetermined process velocity (circumferential velocity) in the clockwise direction in FIG. 1. The reference character M1 denotes a main motor of the image forming apparatus main body for driving the photosensitive drum 1 and the like.

The reference numeral 32 denotes a controller for the main motor M1, which is controlled by the CPU 30. The CPU 30 controls respective parts of the image forming apparatus according to the control procedures stored in the ROM 61. The reference numeral 62 denotes a RAM for providing a work area of the CPU 30.

The photosensitive drum 1 is uniformly primarily charged to a predetermined polarity and potential by the charging roller 2 during its rotation process. The optical image exposure L is performed on the charged surface by an exposure device (not shown) to form an electrostatic latent image corresponding to target image information.

Then, the latent image is visualized as a toner image by the developing portion 3 and the toner image reaches the transfer nip portion T. The transfer nip portion T is a pressure nip portion between the photosensitive drum 1 and the transfer roller 4 constituting the transfer portion. In synchronization with the formation of the toner image, the sheet P is conveyed from the sheet feeding portion (not shown) to the transfer nip portion T. At the transfer nip portion T, the toner image is sequentially transferred onto the sheet P by applying a bias to the transfer roller 4 while the sheet P is conveyed at the sheet conveying velocity (transfer conveying velocity) by the rotation of the photosensitive drum 1 and the transfer roller 4.

The transfer roller 4 is connected to the photosensitive drum 1 via a gear, and is similarly rotated by the main motor M1 as a driving source.

The sheet P to which the toner image has been transferred is separated from the surface of the photosensitive drum 1 and is conveyed on the conveying guide 5 to the fixing portion 7. The toner image on the sheet P is thermally fixed in the fixing portion 7 and outputted as an image formed product (copy, print).

After the transfer of the toner image to the sheet P, the surface of the photosensitive drum 1 is subjected to removal processing of residual deposits such as transfer residual toner and the like by the cleaning portion 6, and is repeatedly used for image formation.

Fixing Portion

The fixing portion 7 of the present embodiment is a heating device of a tensionless film heating type with a pressure member driven system. The reference character 8 denotes a horizontally elongated stay made of heat-resistant resin, which serves as an inner surface guide member of the endless heat-resistant film (fixing film) 9.

The endless heat-resistant film 9 is externally fitted to the stay 8 including the heater 40 as a heating body.

The pressure roller 50 forms a fixing nip portion N which is a pressure nip which nips the film 9 between the pressure roller 50 and the heater 40, and is a pressure roller as a rotating body for driving the film 9. The pressure roller 50 is composed of the core metal 51 such as aluminum, iron, stainless steel, and the heat-resistant rubber elastic body 52 having good toner parting properties such as silicone rubber externally mounted on the shaft of the pressure roller 50. A coating layer (not shown) in which fluororesin is dispersed for the reasons of transportability of the sheet P and the fixing film 9, and of prevention of contamination of the toner is provided on the surface of the pressure roller 50.

The end portion of the core metal 51 is driven by the fixing motor M2 and the pressure roller 50 is rotated in the counterclockwise direction in FIG. 1. By this driving force, the inner surface of the endless heat-resistant film 9 is rotated in the clockwise direction while being in a close sliding contact with the heater 40.

More specifically, when the pressure roller 50 is driven to rotate, a moving force is applied to the film 9 at the fixing nip portion N by a frictional force with the rotating pressure roller 50. Therefore, with the substantially same velocity as the rotational circumferential velocity of the pressure roller 50, the film 9 is rotationally driven in the clockwise direction with the inner surface of the film 9 sliding on the surface of the heater 40. The sheet to which the toner image has been transferred in the transfer portion is conveyed at the fixing conveying velocity by the rotation of the pressure roller 50 while being heated and pressed to fix the toner image on the sheet.

The driving of the main motor M1 and the fixing motor M2 is controlled by the CPU 30 through corresponding controllers 32 and 33, respectively. The pressure roller 50 is rotated at the rotational speed according to the rotational velocity of the fixing motor M2. The main motor M1 and the fixing motor M2 are controlled such that the sheet conveying velocity becomes the process velocity.

Further, in order to keep the loop amount of the sheet P in the transfer nip portion T and the fixing nip portion N within a predetermined range, the CPU 30 controls the sheet conveying velocity (fixing conveying velocity) Vf at the fixing nip portion N by switching the rotational velocity of the fixing motor M2.

Loop Detection Unit

A loop detecting portion for detecting a loop amount of the sheet P with the detection flag 21 is provided on the sheet conveying paths of the transfer portion and the fixing portion. The detection flag 21 is constituted by a bar-like member which is capable of swinging around the swing shaft 21A. The detection flag 21 is provided on the surface of the conveying guide 5 which is provided between the transfer portion and the fixing portion. The detection flag 21 is arranged such that the end portion of the detection flag 21 protrudes toward the conveying surface of the conveying guide 5. The detection flag 21 is urged by a spring member (not shown), is pushed by the sheet P which contacts the end portion of the detection flag 21 from above, and swings according to the loop amount formed by the sheet P. The detection flag 21 is provided with a light shielding flag 21B extending downward of the conveying surface. In association with the movement of the detection flag 21, the light shielding flag 21B blocks/opens the optical path of the photo interrupter 22 for detecting whether the loop amount of the sheet P exceeds a predetermined value or not. That is, the photo interrupter 22 is turned on/off according to the swing motion of the detection flag 21. The photo interrupter 22 and the detection flag 21 cooperate with each other to constitute a loop detecting sensor 20 working as a loop detecting portion.

Note that the loop amount detected by the loop detecting sensor 20 is the difference between the distance between the two points of the transfer nip portion T and the fixing nip portion N and the distance between the two points connected on the sheet P with a loop. That is, the loop amount is the difference between the distance between the two point on the sheet when the sheet conveying velocity (fixing conveying velocity) Vf at the fixing nip portion N is set to the same velocity as the sheet conveying velocity (transfer conveying velocity) Vt at the transfer nip portion T and the distance between the two point on the sheet when the fixing conveying velocity Vf is controlled such that the sheet P has a loop. Therefore, when the fixing conveying velocity Vf is set to be lower than the transfer conveying velocity Vt, the loop amount increases, and when the fixing conveying velocity Vf is set to be higher than the transfer conveying velocity Vt, the loop amount decreases.

The output of the loop detecting sensor 20 is fetched by the CPU 30, and a control is performed based on the information processed by the CPU 30.

Loop Control

Figure 2:
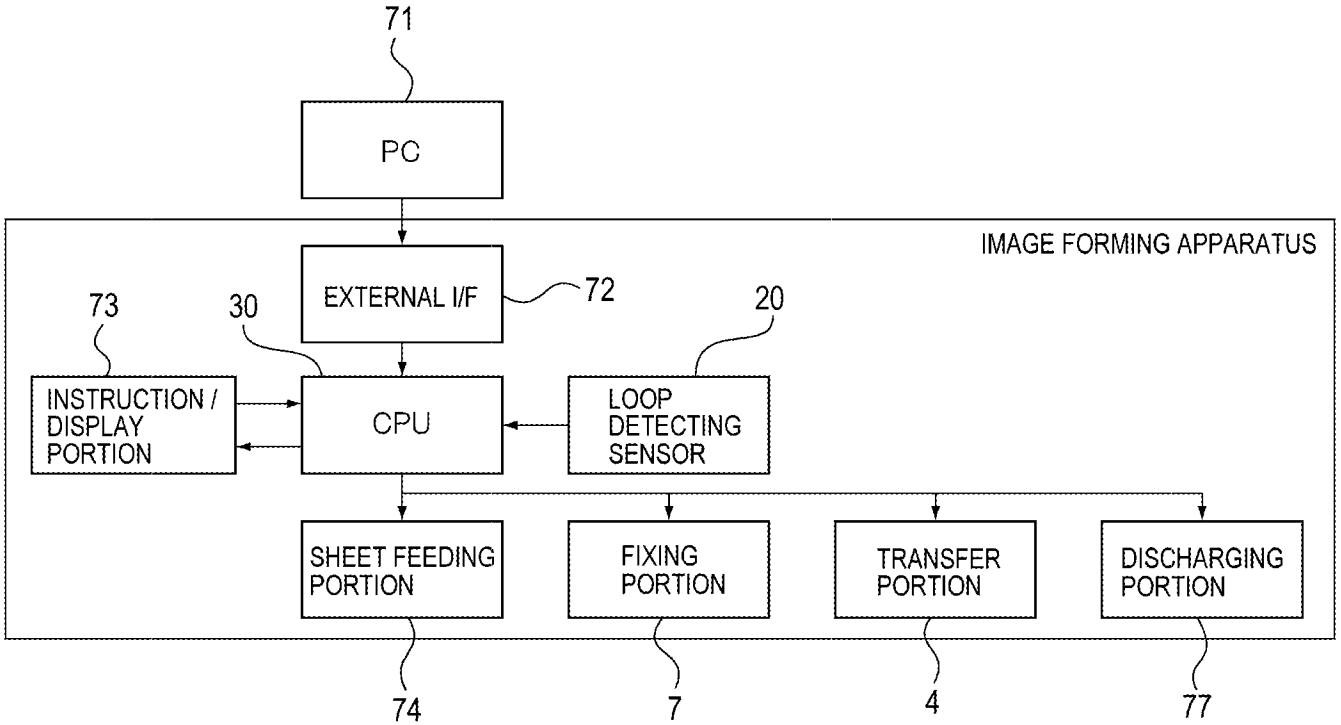
FIG. 2 is a block diagram of a loop control.

The loop control of a sheet will be described. FIG. 2 is a block diagram showing the configuration of a control portion for the loop control. The fixing conveying velocity is switched and the loop amount is controlled by the control portion.

Control Portion

As shown in FIG. 2, when an instruction for print is issued from the PC 71, a signal is received from the I/F portion 72 such as a USB port of the image forming apparatus with a transmission portion (not shown) such as a USB cable. Alternatively, a signal may be received from the instruction/display portion 73. When the image forming apparatus receives the signal, the CPU 30 performs the operations of the sheet feeding portion 74, the fixing portion 7, the transfer portion 4 and the discharging portion 77 necessary for image formation. At that time, by changing the operation of the fixing portion 75 by the loop detecting sensor 20, printing with good image quality is completed.

In the present embodiment, the switching of the fixing conveying velocity is controlled based on the determination of the mutual relationship between the transfer conveying velocity and the fixing conveying velocity, which eliminates the need of setting a sheet conveying velocity in consideration of all of design size variations of the image forming apparatus and surface property variations of respective rollers, so that it becomes possible to perform a control with an optimum sheet conveying velocity in an actually used image forming apparatus.

Normal Loop Control

Next, the loop control operation will be described. A normal loop control will be described first and then a corrected loop control which is a feature of the present embodiment will be described.

Figure 3:
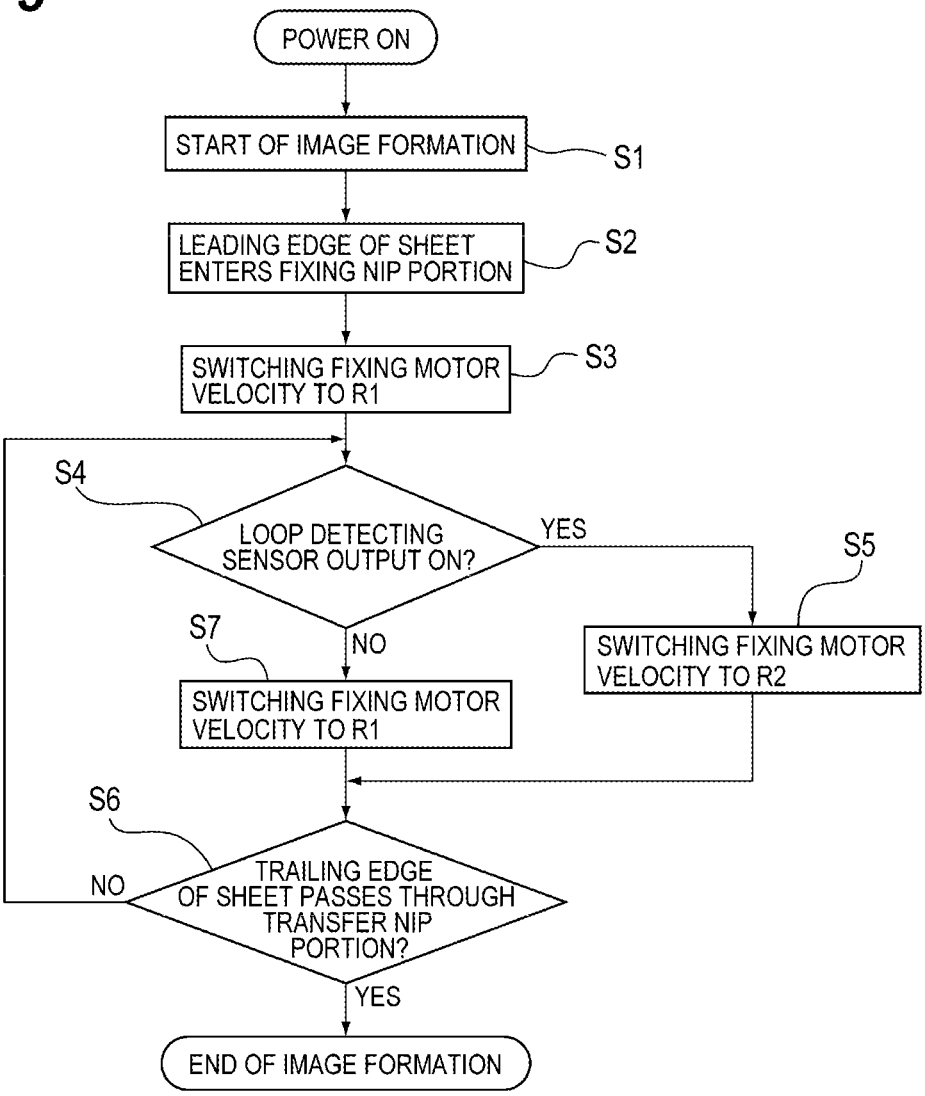
FIG. 3 is a flowchart showing an operational flow from the start of the image forming operation to the end of the image forming operation through a normal loop control.

The operational flow from the start of the image forming operation to the end of the image forming operation through the normal loop control will be described with reference to FIGS. 3 and 4.

When a signal for starting image formation is inputted after the image forming apparatus is turned on (step S1), the sheet P to which unfixed toner has been transferred is conveyed toward the fixing nip portion N as described above.

Figure 4:
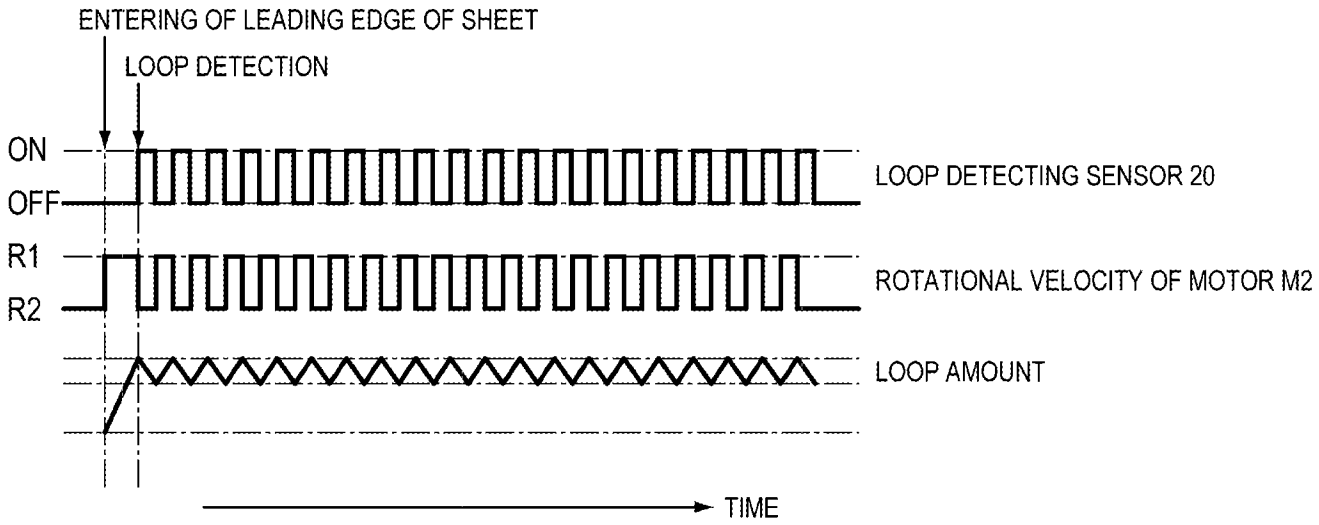
FIG. 4 is a graph showing the relationship among a loop detection sensor, a rotational velocity of a motor, and a loop amount during the normal loop control.

When the leading edge of the sheet P enters the fixing nip portion N of the fixing portion 7 (step S2), the rotation velocity of the fixing motor M2 is switched to R1 (step S3) as shown in FIG. 4, and the fixing conveying velocity Vf is set to Vb which is lower than the transfer conveying velocity Vt by the CPU 30. Next, the sequence proceeds to step S4 where it is determined whether the output of the loop detecting sensor 20 is ON or OFF. The loop detecting sensor 20 is turned ON when the loop is larger than a predetermined amount and is turned OFF when the loop becomes smaller than the predetermined amount.

The rotational velocity R1 of the fixing motor M2 is a rotational velocity at which the fixing conveying velocity Vf becomes lower than the transfer conveying velocity Vt. It is necessary to set the velocity Vb such that Vt>Vb without fail in any situations in consideration of the conditions such as a type of the sheet P, the number of continuously fed sheets, the thermal expansion of respective parts according to situations of fixing temperature control, variations in the applied pressure, and the tolerance of the roller diameter.

The timing at which the leading edge of the sheet P enters the fixing nip portion N is calculated from the timing of the start of the image formation by the CPU 30. Then, when the leading end of the sheet P is nipped at the fixing nip portion N after the leading edge of the sheet P goes over the position of the detection flag 21, a downward convex loop is formed on the sheet P for the following reasons.

That is, the downward convex loop is formed on the sheet P by the fact that the fixing conveying velocity Vf is set to the velocity Vb which is lower than the transfer conveying velocity Vt, and by the sheet separation angle at the transfer nip portion T and the inclination angle of the fixing portion 7. In addition, the sheet P is conveyed with its lower surface being supported on the detection flag 21. Since the detection flag 21 is urged by the spring member as described above, the detection flag 21 does not swing to the position where the photo interrupter 22 is turned on until the loop amount of the sheet P exceeds the predetermined amount.

As the sheet P further progresses, the loop amount of the sheet P gradually increases. When the loop amount exceeds the predetermined amount, the detection flag 21 swings while resisting the urging force of the spring member, and the photo interrupter 22 is turned on (the output of the loop detecting sensor 20 is ON). When the photo interrupter 22 is turned on, the sequence proceeds to "YES" in step S4, and the CPU 30 determines that the loop amount of the sheet P exceeds the predetermined amount, and switches the rotational velocity of the fixing motor M2 from R1 to R2 (step S5). As a result, the fixing conveying velocity Vf becomes a velocity Va which is higher than the transfer conveying velocity Vt, so that the loop amount of the sheet P between the transfer nip portion T and the fixing nip portion N gradually decreases.

The rotational velocity R2 of the fixing motor M2 is a rotation velocity at which the fixing conveying velocity Vf becomes higher than the transfer conveying velocity Vt. Similarly to the above described Vb, it is necessary to set the velocity Va such that Va>Vt without fail in any situations in consideration of the conditions such as a type of the sheet P, the number of continuously fed sheets, the thermal expansion of respective parts according to situations of fixing temperature control, variations in the applied pressure, and the tolerance of the roller diameter.

Next, in step S6, it is determined whether or not the trailing edge of the sheet P has passed through the transfer nip portion T. Similarly to the entering timing, the timing at which the trailing edge of the sheet P passes through the fixing nip portion N is also calculated by the CPU 30.

When the loop amount of the sheet P decreases to some extent, the detection flag 21 swings in the returning direction, and the photo interrupter 22 is turned off. When the photo interrupter 22 is turned off, it is determined as No in step S4, the CPU 30 determines that the loop amount of the sheet P has become smaller than the predetermined amount, and switches the rotational velocity of the fixing motor M2 from R2 to R1 (step S7) and the sequence proceeds to step S6. As a result, the fixing conveying velocity Vf becomes a velocity Vb which is lower than the transfer conveying velocity Vt, and the loop amount of the sheet P between the transfer nip portion T and the fixing nip portion N increases again.

By repeating the loop control of switching the rotational velocity of the fixing motor M2 in accordance with the ON/OFF state of the photo interrupter 22, the sheet P can be conveyed with the loop amount of the sheet P between the transfer nip portion T and the fixing nip portion N being maintained within a predetermined range.

By repeating this operation until the trailing edge of the sheet passes through the transfer nip portion T ("NO" in step S6), it is possible to maintain the conveying state in which looseness or tension does not occur. However, as described above, in consideration of various factors, the fixing conveying velocity Vf is set to the velocity Va which is higher than the transfer conveying velocity Vt without fail, or to the velocity Vb which is lower than the transfer conveying velocity Vt without fail, so the sheet P on which unfixed toner is placed and the fixing film 9 sometimes deviate slightly from each other when the fixing conveying velocity Vf is changed. In this case, problems such as scattering of characters and images sometimes occur on the sheet. In order to avoid image defects, it is preferable to set the velocity difference (the difference between R1 and R2) of the fixing conveying velocity Vf during loop control to a small value.

Corrected Loop Control

In the present embodiment, in addition to the above described normal loop control, the corrected loop control is performed. In the corrected loop control, in order to reduce the velocity difference at the time of loop control, the control is performed by associating the detection time of the loop detecting sensor 20, the velocity of the fixing motor M2, and the switching timing of the fixing motor M2, so that processing is made at an optimum value while the velocity difference of the fixing conveying velocity Vf is suppressed to a small value.

Figure 5:
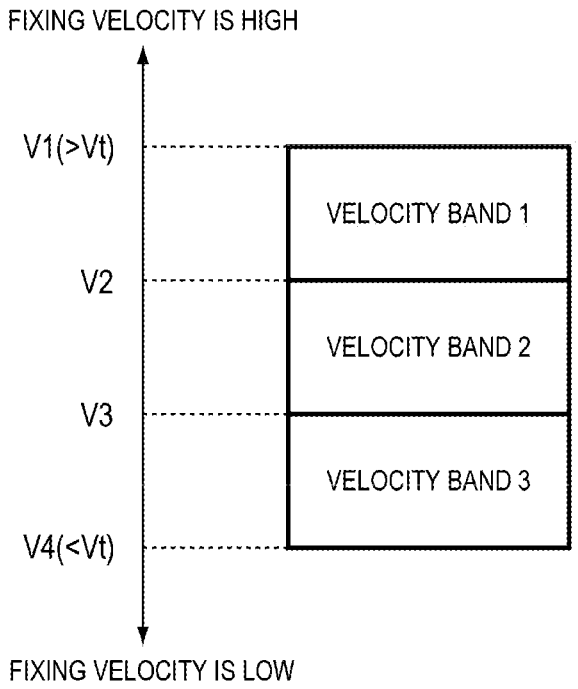
FIG. 5 is a diagram showing settings for performing a corrected loop control.

The setting of the operation of the corrected loop control will be described with reference to FIG. 5. First, the velocity of the fixing motor M2 has four levels from V1 to V4. V1 is a velocity which is higher than the transfer conveying velocity Vt and V4 is a velocity lower than the transfer conveying velocity Vt. It is necessary to set the velocities V1 and V4 such that V1>Vt>V4 without fail in any situations in consideration of the conditions such as a type of the sheet P, the number of continuously fed sheets, the thermal expansion of respective parts according to situations of fixing temperature control, variations in the applied pressure, and the tolerance of the roller diameter.

Then, the velocity range between V1 and V4 is divided into three bands with substantially equal intervals. As shown in FIG. 5, the velocity range from V1 to V4 is divided by V2 and V3 with substantially equal intervals (V1>V2>V3>V4). That is, in accordance with switching of ON/OFF of the loop detecting sensor 20, the velocity band 1, the velocity band 2 and the velocity band 3 are set. In the velocity band 1, the loop control is performed between V1 and V2. In the velocity band 2, the loop control is performed between V2 and V3. In the velocity band 3, the loop control is performed between V3 and V4.

According to the loop state detected by the loop detecting sensor 20, the velocity control is performed such that the fixing conveying velocity vf is set to a first velocity which is a higher velocity when the loop amount is large so as to decrease the loop amount, and the fixing conveying velocity vf is switched to a second velocity which is lower than the first velocity when the loop amount is smaller so as to increase the loop amount. Each of the velocity bands 1, 2 and 3 has a different combination of the first velocity and the second velocity from each other. The first velocity of the velocity band 1 is V1 and the second velocity of the velocity band 1 is V 2. The first velocity of the velocity band 2 is V2 and the second velocity of the velocity band 2 is V3. The first velocity of the velocity band 3 is V3 and the second velocity of the velocity band 3 is V4. The first velocity and the second velocity are determined by the rotational velocity of the fixing motor.

In the present embodiment, the loop control starts the operation from velocity band 1, which is the highest velocity combination of the first velocity and the second velocity among the plurality of velocity bands so that the loop detecting sensor 20 can detect the loop state. Then, the first velocity is set to V1 and the second velocity is set to V2. When the loop detecting sensor 20 detects OFF (small loop), the fixing conveying velocity Vf is set to the second velocity V2 and the sheet P is conveyed so as to increase the loop amount. When the loop detecting sensor 20 detects ON (large loop), the fixing conveying velocity Vf is switched to the first velocity V1 so as to decrease the loop amount. That is, when the loop amount is large within the predetermined amount, the fixing conveying velocity is switched to the first velocity, and when the loop amount is small within the predetermined amount, the loop velocity is switched to the second velocity, in order to keep the loop amount within the predetermined amount.

On the other hand, when the loop amount does not fall within the predetermined amount in the velocity control in the velocity band 1, the velocity band is switched to another velocity band. Specifically, when the loop detecting sensor 20 continuously detects OFF (small loop) for a predetermined period of time or longer, for 100 ms or longer in the present embodiment in the velocity band 1, it is determined that the fixing conveying velocity Vf is too high in the velocity band 1, and the loop amount is smaller than the predetermined amount, so the velocity band 1 is switched to the velocity band 2 in which the combination of the first velocity and the second velocity is one step lower. Similarly, when the loop detecting sensor 20 continuously detects OFF (small loop) for 100 ms or longer in the velocity band 2, it is determined that the fixing conveying velocity Vf is too high in the velocity band 2, the velocity band 2 is switched to the velocity band 3 in which the combination of the first velocity and the second velocity is one step lower.

On the contrary, in the case where the loop control is performed with the velocity bands 2 or 3, when the loop detecting sensor 20 continuously detects ON (large loop) for the predetermined time or longer (100 ms or longer in the present embodiment), the velocity bands 2 or 3 is switched to velocity bands 1 or 2, respectively. If the velocity band cannot be changed, a further change is not made.

Figure 6A:
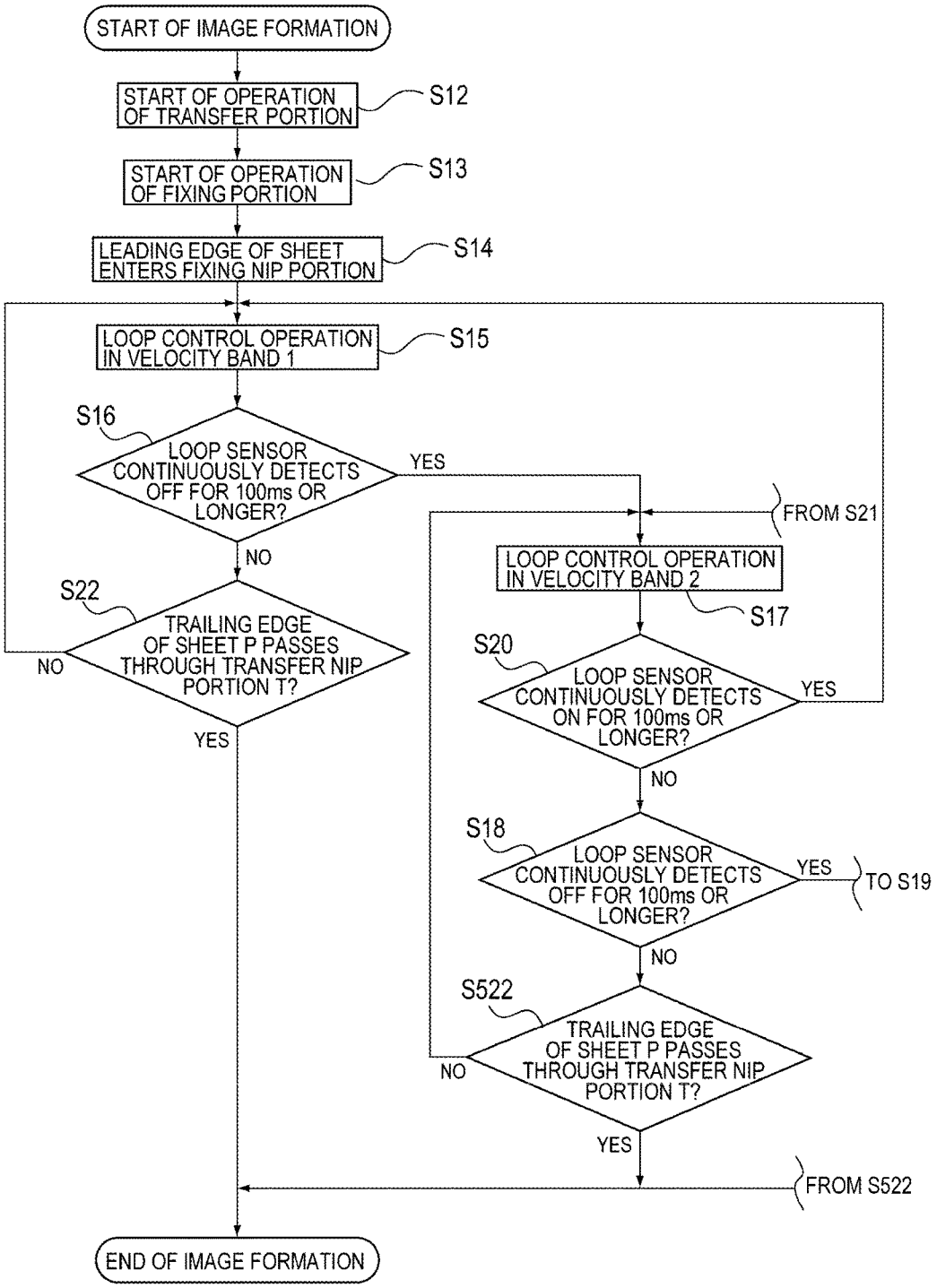
FIGS. 6A and 6B are flowcharts showing an operational flow from the start of the image forming operation to the end of the image forming operation through the example of the corrected loop control.
Figure 6B:
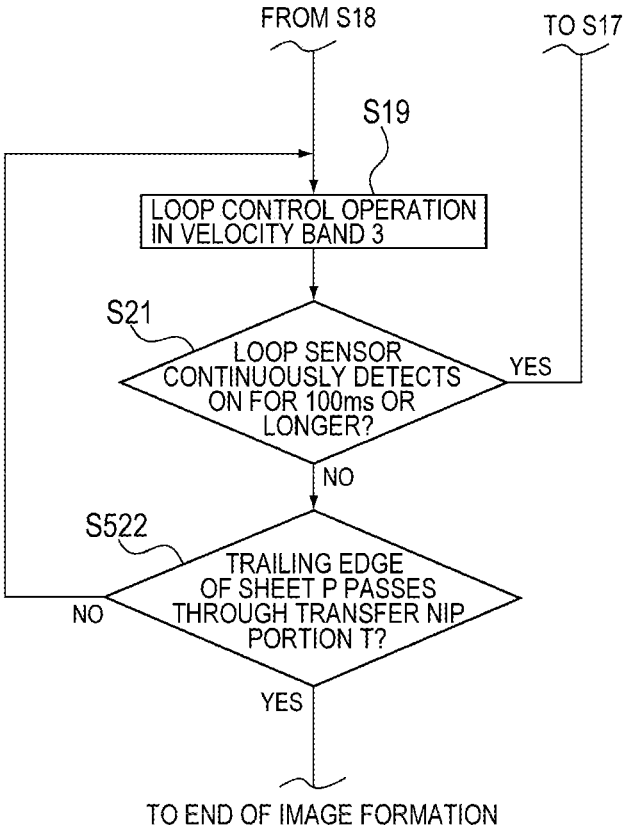

FIG. 6 is a flowchart showing the operations for performing the corrected loop control. First, when a signal for starting image formation is input after the power of the image forming apparatus is turned on, the operations of the transfer portion and the fixing portion are performed (steps S12 and S13). Thereafter, when the leading edge of the sheet P enters the fixing nip portion (step S14), the loop control is started with the velocity band 1 (step S15). When the loop detecting sensor 20 continuously detects OFF (small loop) for 100 ms during operations in the velocity band 1, that is, when the lower velocity V2 of the velocity band 1 continues for 100 ms ("YES" in step S16), the velocity control is switched to the control in the lower velocity band 2 (step S17). Further, when the loop detecting sensor 20 continuously detects OFF (small loop) for 100 ms during operations in the velocity band 1 (step S18), that is, when the lower velocity V3 continues for 100 ms ("YES" in step S18), the velocity control is switched to the control in the lower velocity band 3 (step S19).

Conversely, when the loop detecting sensor 20 continuously detects ON (loop large) for 100 ms during the operations in the velocity band 2, that is, when the higher velocity V2 continues for 100 ms ("YES" in step S20), the fixing conveying velocity control is switched to a control in the velocity band 1 which is one step higher than the velocity band 2 (step S15). Similarly, when the loop detecting sensor 20 continuously detects ON (large loop) for 100 ms during the operations in the velocity band 3, that is, when the higher velocity V3 continues for 100 ms ("YES" in step S21), the fixing conveying velocity control is switched to a control in the velocity band 2 which is one step higher than the velocity band 3 (step S17).

In either state, at the time when the trailing edge of the sheet P passes through the transfer nip portion T (step S22), the image formation is completed.

As described above, the loop control is performed such that a plurality of velocity bands are provided, which are combinations of a first velocity and a second velocity with a small difference between them, which is the difference between fixing conveying velocities to be switched when the loop control is performed, and the velocity bands are sequentially switched according to the detected loop state. As a result, it is possible to set the velocity difference of the fixing conveying velocity in the loop control to a small value, so that it is possible to suppress scattering of toner, image stretches and the like on the sheet.

The above control is repeated after the leading edge of the sheet to which the toner image is transferred reaches the fixing nip portion until the trailing edge of the sheet passes through the transfer nip portion. As a result, a proper loop control can be performed even when the outer diameter tolerance and the surface property variation of the roller occur due to thermal expansion of the pressure roller 50 or the like during sheet conveyance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-035778, filed Feb. 28, 2017, which is hereby incorporated by reference herein in its entirety.

What is claimed is:

1. An image forming apparatus, comprising:

a transfer portion configured to convey a sheet and to transfer a toner image formed on an image bearing member to the sheet;

a fixing portion configured to convey the sheet at a fixing conveying velocity and to fix the toner image transferred to the sheet;

a loop detecting portion configured to detect a state of a loop of the sheet, the loop being formed between the transfer portion and the fixing portion; and a control portion configured to control the fixing portion such that the fixing conveying velocity is changed to a first velocity or to a second velocity which is lower than the first velocity based on the state of the loop detected by the loop detecting portion, wherein the control portion can set a plurality of velocity bands each of which is a combination of the first velocity and the second velocity, the control portion can perform a changing of the velocity band a several times based on the state of the loop of the sheet detected by the loop detecting portion while the transfer portion and the fixing portion are conveying the sheet.

2. The image forming apparatus according to claim 1, wherein when the loop amount detected by the loop detecting portion is larger than a predetermined amount, the control portion switches the fixing conveying velocity to the first velocity in a set velocity band, and when the loop amount detected by the loop detecting portion is smaller than the predetermined amount, the control portion switches the fixing conveying velocity to the second velocity in a set velocity band.

3. The image forming apparatus according to claim 1, wherein the plurality of velocity bands includes a first velocity band and a second velocity band, the first velocity in first velocity band is faster than the first velocity in second velocity band, and the second velocity in first velocity band is faster than the second velocity in second velocity band and wherein the control portion switches to the first velocity band if a state in which the second velocity band is set and the loop amount is larger than the predetermined amount continues for a predetermined period of time, and wherein the control portion switches to the second velocity band if a state in which the first velocity band is set and the loop amount is smaller than the predetermined amount continues for a predetermined period of time.

4. The image forming apparatus according to claim 1, wherein the plurality of velocity bands include a first velocity band and a second velocity band with a lower velocity combination than that of the first velocity band, and wherein when the first velocity of the first velocity band is given as V11, the second velocity of the first velocity band is given as V12, the first velocity of the second velocity band is given as V21, and the second velocity of the second velocity band is given as V22, the relationship V11>V21 and V12>V22 holds.

5. The image forming apparatus according to claim 4, wherein the relationship V12=V21 further holds.

6. The image forming apparatus according to claim 1, wherein the control portion is configured to be able to perform the changing of the velocity band a several times until a trailing edge of the sheet passes through the transfer portion after a leading edge of the sheet reaches the fixing portion.

7. The image forming apparatus according to claim 1, wherein the transfer portion is configured to convey a sheet at a transfer conveying velocity, and wherein the plurality of velocity bands are continuous velocity bands which divide a velocity range between a first sheet conveying velocity which is lower than the transfer conveying velocity and a second sheet conveying velocity which is higher than the transfer conveying velocity into a plurality of regions.

8. The image forming apparatus according to claim 1, wherein differences between the first velocity and the second velocity in the plurality of velocity bands are the same.

9. The image forming apparatus according to claim 1, wherein the sheet is conveyed by rotating a roller with a motor in the fixing portion, and wherein the first velocity and the second velocity are determined by a rotational velocity of the motor.

10. The image forming apparatus according to claim 1, wherein one of the plurality of velocity bands includes a first sheet conveying velocity which is lower than the transfer conveying velocity, and wherein other of the plurality of velocity bands includes a second sheet conveying velocity which is faster than the transfer conveying velocity.

11. An image forming apparatus, comprising:

a transfer nip configured to convey a sheet and to transfer a toner image to the sheet;

a fixing portion having a rotating member configured to convey the sheet and a motor configure to rotate the rotating member, wherein the fixing portion is configured to fix the toner image transferred to the sheet conveyed by the rotating member;

a detecting portion configured to detect the sheet, being conveyed by the transfer nip and the fixing portion, between the transfer nip and the rotating member; and a control portion configured to control the motor such that a rotational speed of the rotating member is set to a first speed or to a second speed which is lower than the first speed based on a detecting result of the detecting portion, wherein the control portion can set one of a plurality of speed bands each of which is a combination of the first speed and the second speed, the control portion can perform a changing of the set speed band a several times based on the detecting result of the detecting portion while the transfer nip and the rotating member are conveying the sheet.

12. The image forming apparatus according to claim 11, wherein when a loop amount of the sheet detected by the detecting portion is larger than a predetermined amount, the control portion switches the rotational speed of the rotating member to the first speed in a set speed band, and when the loop amount of the sheet detected by the detecting portion is smaller than the predetermined amount, the control portion switches the rotational speed of the rotating member to the second speed in a set speed band.

13. The image forming apparatus according to claim 11, wherein the plurality of speed bands includes a first speed band and a second speed band, the first speed in first speed band is faster than the first speed in second speed band, and the second speed in the first speed band is faster than the second speed in the second speed band and wherein the control portion switches to the first speed band if a state in which the second speed band is set and a loop amount of the sheet detected by the detecting portion is larger than the predetermined amount continues for a predetermined period of time, and wherein the control portion switches to the second speed band if a state in which the first speed band is set and the loop amount of the sheet detected by the detecting portion is smaller than the predetermined amount continues for a predetermined period of time.

14. An image forming apparatus, comprising:

a transfer nip configured to convey a sheet and to transfer a toner image to the sheet;

a fixing portion having a rotating member configured to convey the sheet and a motor configured to rotate the rotating member, the fixing portion configured to convey the sheet and to fix the toner image transferred to the sheet conveyed by the rotating member;

a detecting portion configured to detect a loop amount of the sheet, being conveyed by the transfer nip and the fixing portion, between the transfer nip and the rotating member; and a control portion configured to control the motor such that a rotational speed of the rotating member can be set to a first speed, to a second speed which is lower than the first speed, and to a third speed which is lower than the second speed, wherein the control portion sets the rotational speed of the rotating member to the second speed if a loop amount of the sheet detected by the detecting portion is smaller than a predetermined amount in a state that the rotational speed of the rotating member is set to the first speed, the control portion sets the rotational speed of the rotating member to the third speed if a state in which rotational speed of the rotating member is set to the second speed and the loop amount of the sheet detected by the detecting portion is smaller than the predetermined amount continues for a predetermined period of time, and wherein the control portion sets the rotational speed of the rotating member to the second speed if the loop amount of the sheet detected by the detecting portion is larger than the predetermined amount in a state that the rotational speed of the rotating member is set to the third speed.

15. The image forming apparatus according to claim 14, wherein the control portion sets the rotational speed of the rotating member to the first speed if the loop amount of the sheet detected by the detecting portion is larger than the predetermined amount in a state that the rotational speed of the rotating member is set to the second speed.

16. The image forming apparatus according to claim 14, wherein the control portion sets the rotational speed of the rotating member to the first speed if a state in which the rotational speed of the rotating member is set to the second speed and the loop amount of the sheet detected by the detecting portion is larger than the predetermined amount continues for a predetermined period of time.

17. The image forming apparatus according to claim 14, wherein the control portion can set the rotational speed of the rotating member to a fourth speed lower than the third speed, wherein the control portion sets the rotational speed of the rotating member to the fourth speed if a state in which the rotational speed of the rotating member is set to the third speed and the loop amount of the sheet detected by the detecting portion is smaller than the predetermined amount continues for a predetermined period of time, and wherein the control portion sets the rotational speed of the rotating member to the third speed if the loop amount of the sheet detected by the detecting portion is larger than the predetermined amount in a state that the rotational speed of the rotating member is set to the fourth speed.

* * * * *